US011735819B2

(12) United States Patent
Kim et al.

(10) Patent No.: US 11,735,819 B2
(45) Date of Patent: Aug. 22, 2023

(54) COMPACT PATCH AND DIPOLE INTERLEAVED ARRAY ANTENNA

(71) Applicant: QUALCOMM Incorporated, San Diego, CA (US)

(72) Inventors: Jeongil Jay Kim, San Diego, CA (US); Sangkil Kim, Seoul (KR); Darryl Sheldon Jessie, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 333 days.

(21) Appl. No.: 17/075,098

(22) Filed: Oct. 20, 2020

(65) Prior Publication Data

US 2022/0123470 A1 Apr. 21, 2022

(51) Int. Cl.
*H01Q 5/40* (2015.01)
*H01Q 9/06* (2006.01)
*H01Q 9/04* (2006.01)

(52) U.S. Cl.
CPC ..... *H01Q 5/40* (2015.01); *H01Q 9/0407* (2013.01); *H01Q 9/065* (2013.01)

(58) Field of Classification Search
CPC .... H01Q 1/22; H01Q 5/30–40; H01Q 9/0407; H01Q 9/065; H01Q 9/285; H01Q 15/008; H01Q 19/10; H01Q 21/065
See application file for complete search history.

(56) References Cited

U.S. PATENT DOCUMENTS

2012/0154234 A1* 6/2012 Geiler ..... H01Q 15/008 343/795
2014/0097995 A1* 4/2014 McKinzie, III ..... H01Q 21/26 29/601
2015/0070246 A1* 3/2015 Maruyama ..... H01Q 15/008 343/912
2015/0270622 A1* 9/2015 Takasaki ..... H01Q 15/0013 343/837
2017/0317421 A1* 11/2017 Grando ..... H01Q 15/006
2021/0313708 A1* 10/2021 Lee ..... H01Q 21/067

* cited by examiner

*Primary Examiner* — Hasan Islam
(74) *Attorney, Agent, or Firm* — Sunstein LLP/Qualcomm

(57) ABSTRACT

Various wireless device and antenna array configurations are provided. An example wireless device includes at least one radio frequency integrated circuit, at least one patch antenna element operably coupled to the at least one radio frequency integrated circuit, at least one dipole antenna comprising two dipole antenna elements disposed adjacent to the at least one patch antenna element and operably coupled to the at least one radio frequency integrated circuit, and at least one high impedance surface disposed below the at least one dipole antenna and adjacent to the at least one patch antenna element.

20 Claims, 10 Drawing Sheets

COMPACT PATCH AND DIPOLE INTERLEAVED ARRAY ANTENNA

BACKGROUND

A wireless device (e.g., a cellular phone or a smart phone) may include a transmitter and a receiver coupled to an antenna to support two-way communication. The antenna may be enclosed within a housing assembly (e.g., cover) based on portability and aesthetics design considerations. In general, the transmitter may modulate a radio frequency (RF) carrier signal with data to obtain a modulated signal, amplify the modulated signal to obtain an output RF signal having the proper power level, and transmit the output RF signal via the antenna to a base station. For data reception, the receiver may obtain a received RF signal via the antenna and may condition and process the received RF signal to recover data sent by the base station. As the radio frequency used by the wireless device increases, the complexity of the RF transmitting circuitry also increases. To facilitate and/or enable wireless signal applications, numerous types of antennas have been developed, with different antennas used based on the needs of an application, e.g., distance, frequency, operational frequency bandwidth, antenna pattern beam width, gain, beam steering, etc. The physical form factors of many wireless devices are shrinking to meet market expectations. The antenna systems for smaller wireless devices must also decrease to accommodate the smaller form factors.

SUMMARY

An example wireless device according to the disclosure includes at least one radio frequency integrated circuit, at least one patch antenna element operably coupled to the at least one radio frequency integrated circuit, at least one dipole antenna comprising two dipole antenna elements disposed adjacent to the at least one patch antenna element and operably coupled to the at least one radio frequency integrated circuit, and at least one high impedance surface disposed below the at least one dipole antenna and adjacent to the at least one patch antenna element.

Implementations of such a wireless device may include one or more of the following features. The wireless device may include a plurality of patch antenna elements operably coupled the at least one radio frequency integrated circuit, such that the at least one dipole antenna and the at least one high impedance surface are interleaved between the plurality of patch antenna elements. The at least one patch antenna element and the at least one dipole antenna may be configured to send or receive energy having a same frequency. The at least one patch antenna element may be configured to send or receive energy having a first frequency and the at least one dipole antenna may be configured to send or receive energy having a second frequency different from the first frequency. The first frequency may be approximately 28 GHz and the second frequency is approximately 39 GHz. The at least one patch antenna element may be configured to send or receive energy having a first polarization and a second polarization. The at least one high impedance surface may be a mushroom-type high impedance surface. The at least one high impedance surface may be a ring-type high impedance surface. The at least one patch antenna element, the at least one dipole antenna, and the at least one high impedance surface may comprise an antenna module disposed along an edge of the wireless device.

An example antenna module according to the disclosure includes a plurality of patch antenna elements disposed in a row, a plurality of dipole antennas with each dipole antenna comprising two dipole antenna elements, wherein the plurality of dipole antennas are disposed in the row and one or more of the plurality of dipole antennas is disposed between two of the plurality of patch antenna elements, and a plurality of high impedance surfaces, wherein each of the plurality of high impedance surfaces is disposed beneath a respective dipole antenna of the plurality of dipole antennas.

Implementations of such an antenna module may include one or more of the following features. The plurality of patch antenna elements may be four patch antenna elements, the plurality of dipole antennas may be three dipole antennas, and the plurality of high impedance surfaces may be three high impedance surfaces. Each of the plurality of dipole antennas may be configured to send or receive energy via a differential feed network. Each patch antenna element in the plurality of patch antenna elements may be square patches with a length in a range of 2 to 2.5 millimeters. The antenna module may include a radio frequency integrated circuit configured to adjust a power or a radiation beam pattern associated with the plurality of patch antenna elements and the plurality of dipole antennas.

An example method for operating an antenna system according to the disclosure includes operating a plurality of patch antenna elements in an array to send or receive energy having a first frequency, and operating a plurality of dipole antennas in the array to send or receive energy having a second frequency, wherein each of the plurality dipole antennas is disposed above a high impedance surface, and the plurality of dipole antennas and the high impedance surfaces are interleaved between the patch antenna elements in the array.

Implementations of such a method may include one or more of the following features. The plurality of antenna elements and the plurality of dipole antennas may be configured to radiate in the same direction. The first frequency and the second frequency may be the same frequency. The first frequency and the second frequency may be different frequencies. The first frequency may be approximately 28 GHz and the second frequency may be approximately 39 GHz. The method may include operating the plurality of patch antenna elements to send or receive energy having a first polarization and a second polarization.

Items and/or techniques described herein may provide one or more of the following capabilities, as well as other capabilities not mentioned. An antenna module includes an interleaved row of patch antennas and dipole antennas. High impedance surfaces may be disposed beneath the dipole antennas. The patch antennas and the dipole antennas may be configured to send or receive energy at the same frequency or different frequencies. The patches may be single-polarization or dual-polarization configurations. The antenna module may be configured to support dual-band operations in 5G frequency bands such as 28 GHz and 39 GHz. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect.

DETAILED DESCRIPTION

Various configurations of an antenna array are described herein. Some embodiments of such array may have a reduced size when implemented in an antenna module in a mobile device as compared to certain known modules. For example, many mobile devices include millimeter-wave (MMW) modules to support higher RF frequencies (e.g., $5^{th}$ Generation specifications). In general, MMW 5G provides wide bandwidths in small cells, which may require a phased array antenna to overcome high signal propagation loss at mmWave. In some devices, a single phased array antenna module may be used to support multiple MMW bands. Integrating multiple bands into a single module may reduce overall required module size and cost in some implementations. Some existing MMW antenna modules utilize patch antennas and may include dipole antennas located at the edge of the antenna module. The width of certain embodiments of these antenna modules may not be suitable for certain uses in mobile devices with a small (e.g., thin) form factor. The compact patch and dipole interleaved antenna array described herein provides a narrow module size (e.g., less than 3.5 mm) at 5G frequency bands.

Figure 1:
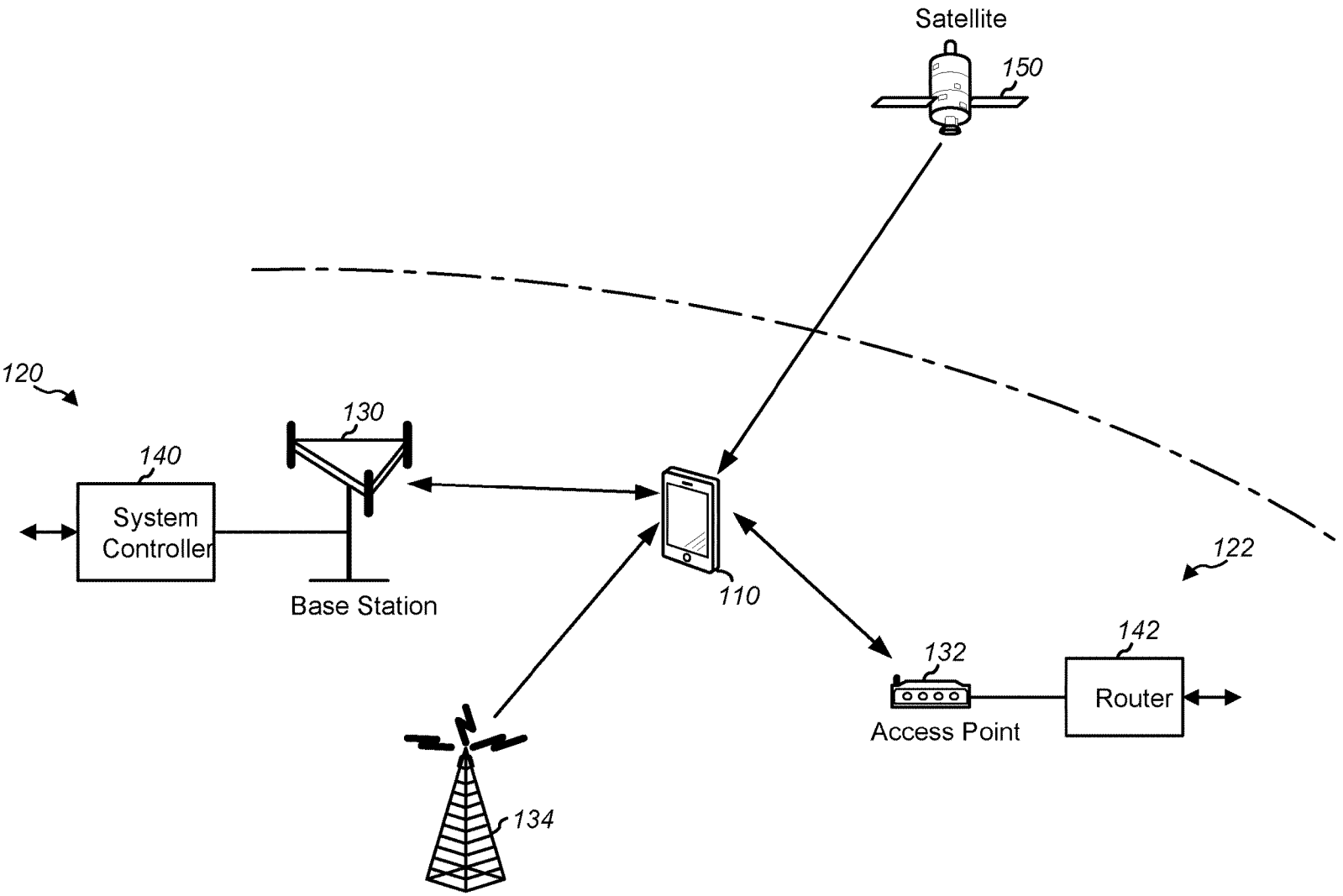
FIG. 1 shows a wireless device capable of communicating with different wireless communication systems.

Referring to FIG. 1, a wireless device 110 capable of communicating with different wireless communication systems 120 and 122 is shown. The wireless system 120 may be a Code Division Multiple Access (CDMA) system (which may implement Wideband CDMA (WCDMA), cdma2000, or some other version of CDMA), a Global System for Mobile Communications (GSM) system, a Long-Term Evolution (LTE) system, a 5G system, etc. The wireless system 122 may be a wireless local area network (WLAN) system, which may implement IEEE 802.11, etc. For simplicity, FIG. 1 shows the wireless system 120 including a base station 130 and a system controller 140, and the wireless system 122 including an access point 132 and a router 142. In general, each system may include any number of stations and any set of network entities.

The wireless device 110 may also be referred to as a user equipment (UE), a mobile device, a mobile station, a terminal, an access terminal, a subscriber unit, a station, etc. The wireless device 110 may be a cellular phone, a smart phone, a tablet, a wireless modem, a personal digital assistant (PDA), a handheld device, a laptop computer, a smartbook, a netbook, a cordless phone, a wireless local loop (WLL) station, an internet of things (IoT) device, a medical device, a device in an automobile, a Bluetooth device, etc. The wireless device 110 may be equipped with any number of antennas. Multiple antennas may be used to provide better performance, to simultaneously support multiple services (e.g., voice and data), to provide diversity against deleterious path effects (e.g., fading, multipath, and interference), to support multiple-input multiple-output (MIMO) transmission to increase data rate, and/or to obtain other benefits. The wireless device 110 may be capable of communicating with one or more wireless systems 120 and/or 122. The wireless device 110 may also be capable of receiving signals from broadcast stations (e.g., a broadcast station 134). The wireless device 110 may also be capable of receiving signals from satellites (e.g., a satellite 150), for example in one or more global navigation satellite systems (GNSS). Further, the wireless device 110 may be configured to communicate directly with other wireless devices (not illustrated), e.g., without relaying communications through a base station or access point or other network device.

In general, the wireless device 110 may support communication with any number of wireless systems, which may employ any radio technologies such as WCDMA, cdma2000, LTE, 5G, GSM, 802.11, GPS, etc. The wireless device 110 may also support operation on any number of frequency bands.

The wireless device 110 may support operation at a very high frequency, e.g., within millimeter-wave (MMW) frequencies from approximately 30 to 300 gigahertz (GHz) or higher. For example, the wireless device 110 may be cable to operate with dual bands. One such configuration includes the 28 GHz and 39 GHz bands. Other very high frequency (e.g., 5G) bands, such as 60 GHz or higher frequency bands, may also be realized with the wireless device 110. The wireless device 110 may include an antenna system to support CA operations at MMW frequencies. The antenna system may include a number of antenna elements, with each antenna element being used to transmit and/or receive signals. The terms "antenna" and "antenna element" are synonymous and are used interchangeably herein. Generally, each antenna element may be implemented with a patch antenna or one or more strip-shaped radiators, for example. A suitable antenna type may be selected for use based on the operating frequency of the wireless device, the desired performance, etc. In an exemplary design, an antenna system may include a number of patch and/or strip-type antennas supporting operation at MMW frequencies.

Figure 2:
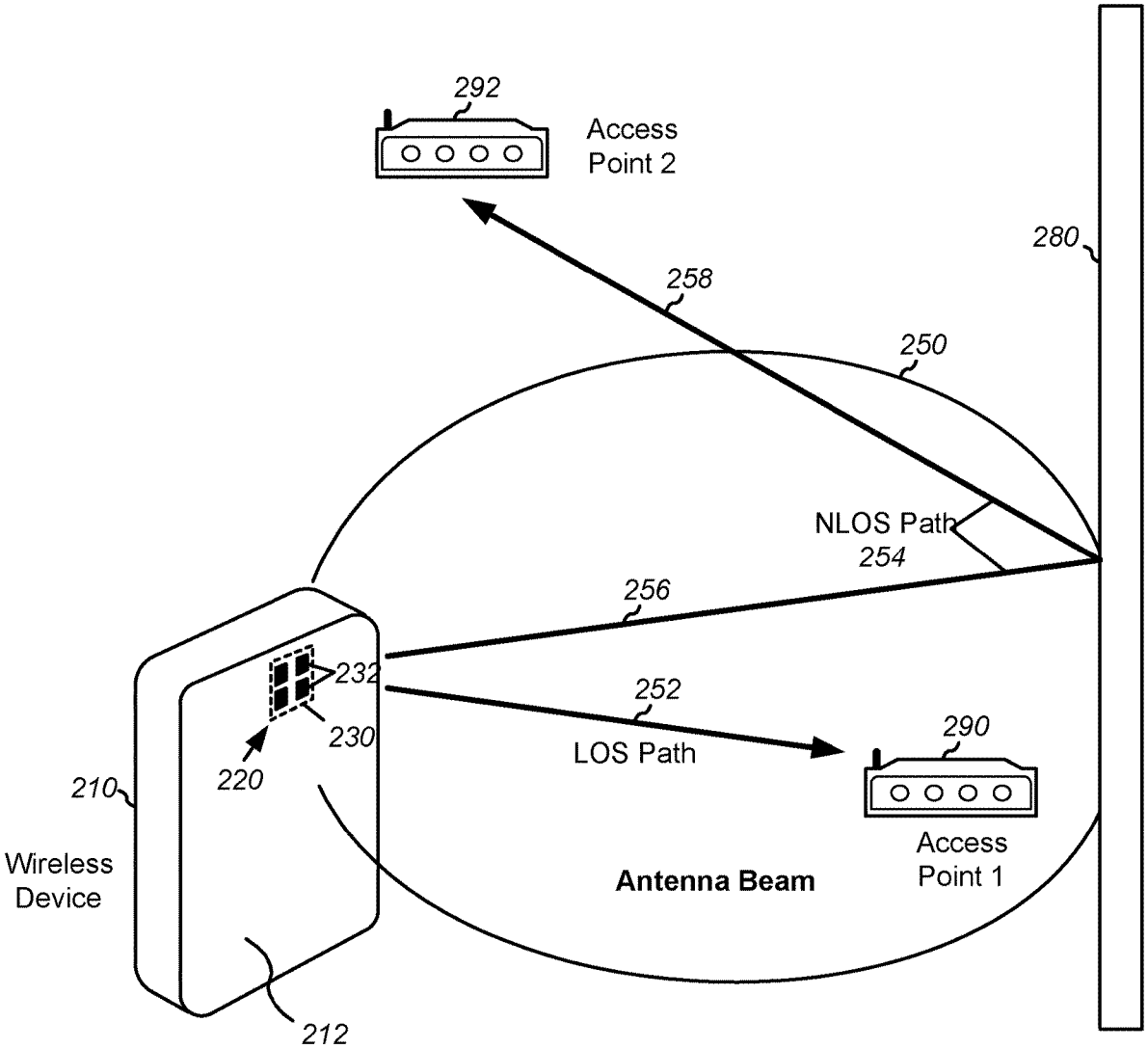
FIG. 2 shows a wireless device with a 2-dimensional (2-D) antenna system.

Referring to FIG. 2, an exemplary design of a wireless device 210 with a 2-D antenna system 220 is shown. In this exemplary design, antenna system 220 includes a 2×2 array 230 of four patch antennas 232 (i.e., radiators) formed on a single geometric plane corresponding to a back surface of wireless device 210 (e.g., a backside array). Those of skill in the art will understand that other array configurations may be utilized. For example, an array with a single row of multiple antennas (e.g., a 1×4 array, a 1×5 array, a 1×6 array, etc.) may be used or an array with a greater number of columns and/or rows may be used.

While the antenna system 220 is visible in FIG. 2, in operation the patch array may be disposed on a PC board, antenna carrier, or other assembly located on an inside surface of a device or cover 212. The patch antenna array 230 has an antenna beam 250, which may be formed to point in a direction that is orthogonal to the plane on which patch antennas 232 are formed or in a direction that is within a certain angle of orthogonal, for example up to 60 degrees in any direction from orthogonal. Wireless device 210 can transmit signals directly to other devices (e.g., access points) located within antenna beam 250 and can also receive signals directly from other devices located within antenna beam 250. Antenna beam 250 thus represents a line-of-sight (LOS) coverage of wireless device 210.

An antenna element may be formed on a plane corresponding to a surface of a wireless device and may be used to transmit and/or receive signals. The antenna element may have a particular antenna beam pattern and a particular maximum antenna gain, which may be dependent on the design and implementation of the antenna element. Multiple antenna elements may be formed on the same plane and used to improve antenna gain. Higher antenna gain may be especially desirable at MMW frequency since (i) it is difficult to efficiently generate high power at MMW frequency and (ii) attenuation loss may be greater at MMW frequency.

For example, an access point 290 (i.e., another device) may be located inside the LOS coverage of wireless device 210. Wireless device 210 can transmit a signal to access point 290 via a line-of-sight (LOS) path 252. Another access point 292 may be located outside the LOS coverage of wireless device 210. Wireless device 210 can transmit a signal to access point 292 via a non-line-of-sight (NLOS) path 254, which includes a direct path 256 from wireless device 210 to a wall 280 and a reflected path 258 from wall 280 to access point 292.

In general, the wireless device 210 may transmit a signal via a LOS path directly to another device located within antenna beam 250, e.g., as shown in FIG. 2. Ideally, this signal may have a much lower power loss when received via the LOS path. The low power loss may allow wireless device 210 to transmit the signal at a lower power level, which may enable wireless device 210 to conserve battery power and extend battery life.

The wireless device 210 may transmit a signal via a NLOS path to another device located outside of antenna beam 250, e.g., as also shown in FIG. 2. This signal may have a much higher power loss when received via the NLOS path, since a large portion of the signal energy may be reflected, absorbed, and/or scattered by one or more objects in the NLOS path. Wireless device 210 may transmit the signal at a high-power level in an effort to ensure that the signal can be reliably received via the NLOS path.

Figure 3:
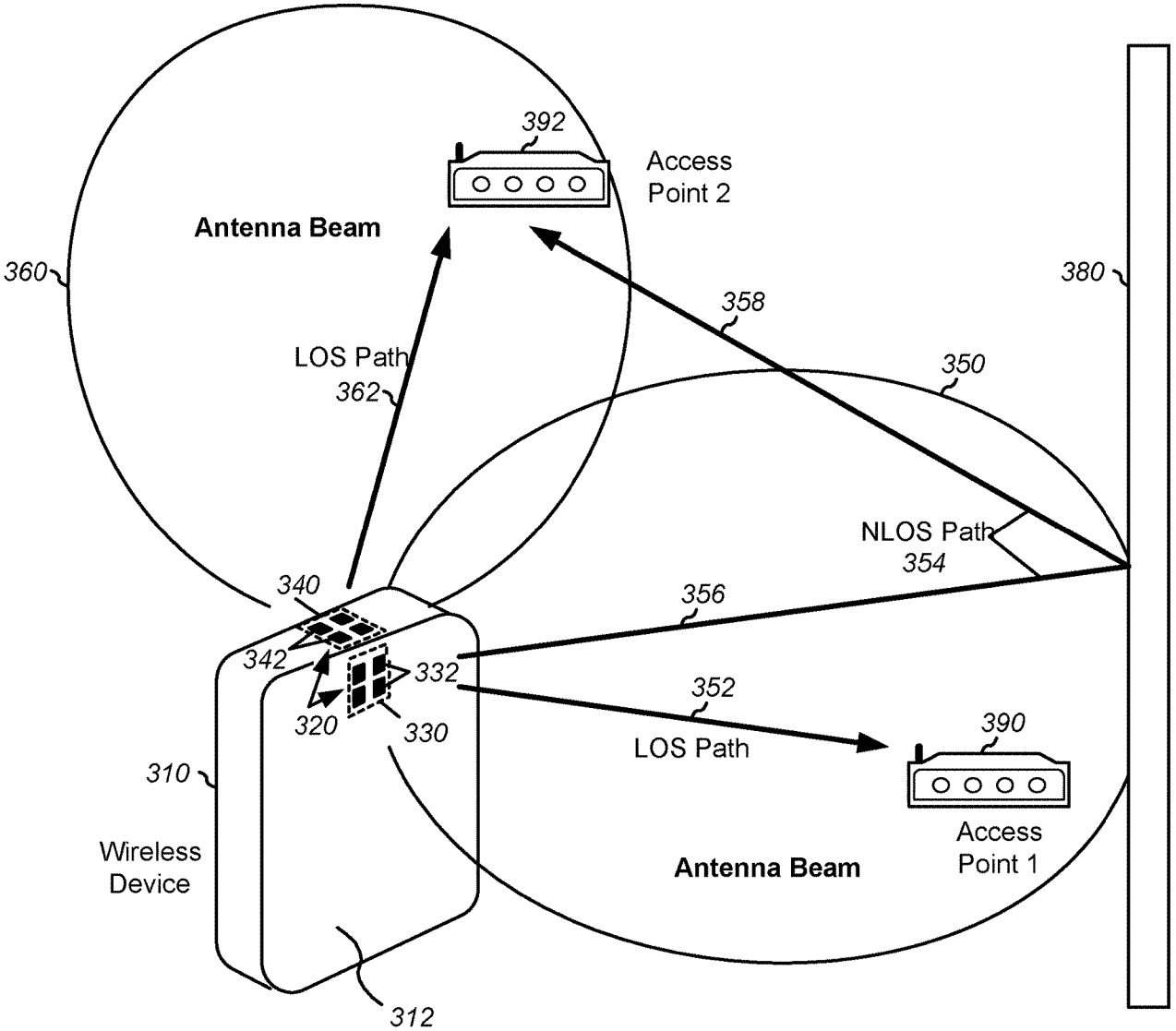
FIG. 3 shows a wireless device with a 3-dimensional (3-D) antenna system.

Referring to FIG. 3, an exemplary design of a wireless device 310 with a 3-D antenna system 320 is shown. In this exemplary design, antenna system 320 includes (i) a 2×2 array 330 of four patch antennas 332 formed on a first plane corresponding to the back surface of wireless device 310 and (ii) a 2×2 array 340 of four patch antennas 342 formed on a second plane corresponding to the top surface of wireless device 310 (e.g., an end-fire array). The patch antenna arrays 330, 340 are disposed on the inside of a device cover 312. The antenna array 330 has an antenna beam 350, which points in a direction that is orthogonal to the first plane on which patch antennas 332 are formed. Antenna array 340 has an antenna beam 360, which points in a direction that is orthogonal to the second plane on which patch antennas 342 are formed. In an example, the arrays 330 and 340 may point in a direction that is within a certain angle of orthogonal, for example up to 60 degrees in any direction from orthogonal. Antenna beams 350 and 360 thus represent the LOS coverage of wireless device 310. While the arrays 330 and 340 are each illustrated as a 2×2 array in FIG. 3, one or both may include a greater or fewer number of antennas, and/or the antennas may be disposed in a different configuration. For example, one or both of the arrays 330 and 340 may be configured as a 1×4, 1×8, 2×4 or other array dimensions.

An access point 390 (i.e., another device) may be located inside the LOS coverage of antenna beam 350 but outside the LOS coverage of antenna beam 360. Wireless device 310 can transmit a first signal to access point 390 via a LOS path 352 within antenna beam 350. Another access point 392 may be located inside the LOS coverage of antenna beam 360 but outside the LOS coverage of antenna beam 350. Wireless device 310 can transmit a second signal to access point 392 via a LOS path 362 within antenna beam 360. Wireless device 310 can transmit a signal to access point 392 via a NLOS path 354 composed of a direct path 356 and a reflected path 358 due to a wall 380. Access point 392 may receive the signal via LOS path 362 at a higher power level than the signal via NLOS path 354.

The wireless device 310 shows an exemplary design of a 3-D antenna system comprising two 2×2 antenna arrays 330 and 340 formed on two planes (e.g., backside and end-fire arrays). In general, a 3-D antenna system may include any number of antenna elements formed on any number of planes pointing in different spatial directions. The planes may or may not be orthogonal to one another. Any number of antennas may be formed on each plane and may be arranged in any formation. The antenna arrays 330, 340 may be formed in an antenna carrier substrate and/or within the device cover 312.

Figure 4:
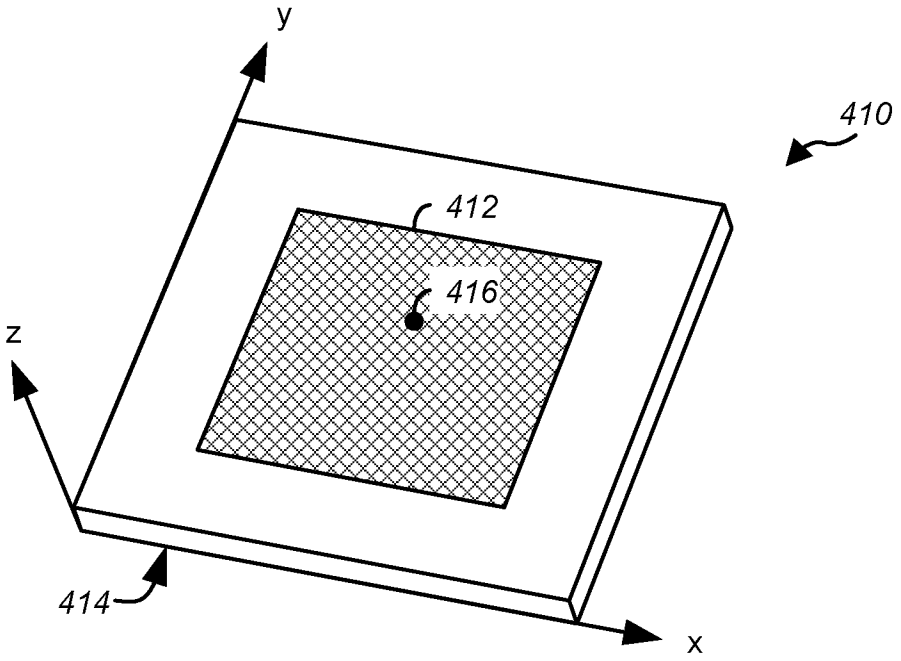
FIG. 4 shows an exemplary design of a patch antenna.

Referring to FIG. 4, an exemplary design of a patch antenna 410 suitable for MMW frequencies is shown. The patch antenna 410 includes a radiator such as a conductive patch 412 formed over a ground plane 414. In an example, the patch 412 has a dimension (e.g., 2.5×2.5 mm) selected based on the desired operating frequency. The ground plane 414 has a dimension (e.g., 4.0×4.0 mm) selected to provide the desired directivity of patch antenna 410. A larger ground plane may result in smaller back lobes. In an example, a feed point 416 is located near the center of patch 412 and is the point at which an output RF signal is applied to patch antenna 410 for transmission. Multiple feed points may also be used to vary the polarization of the patch antenna 410. For example, at least two conductors may be used for dual polarization (e.g., a first conductor and a second conductor may be used for a horizontal-pol feed line and a vertical-pol feed line). The locations and number of the feed points may be selected to provide the desired impedance match to a feedline and/or to provide the desired polarizations. Additional patches may be assembled in an array (e.g., 1×2, 1×3, 1×4, 2×2, 2×3, 2×4, 3×3, 3×4, etc. . . . ) to further provide a desired directivity and sensitivity. The ground plane 414 may be disposed under all of the patches in the array.

Figure 5A:
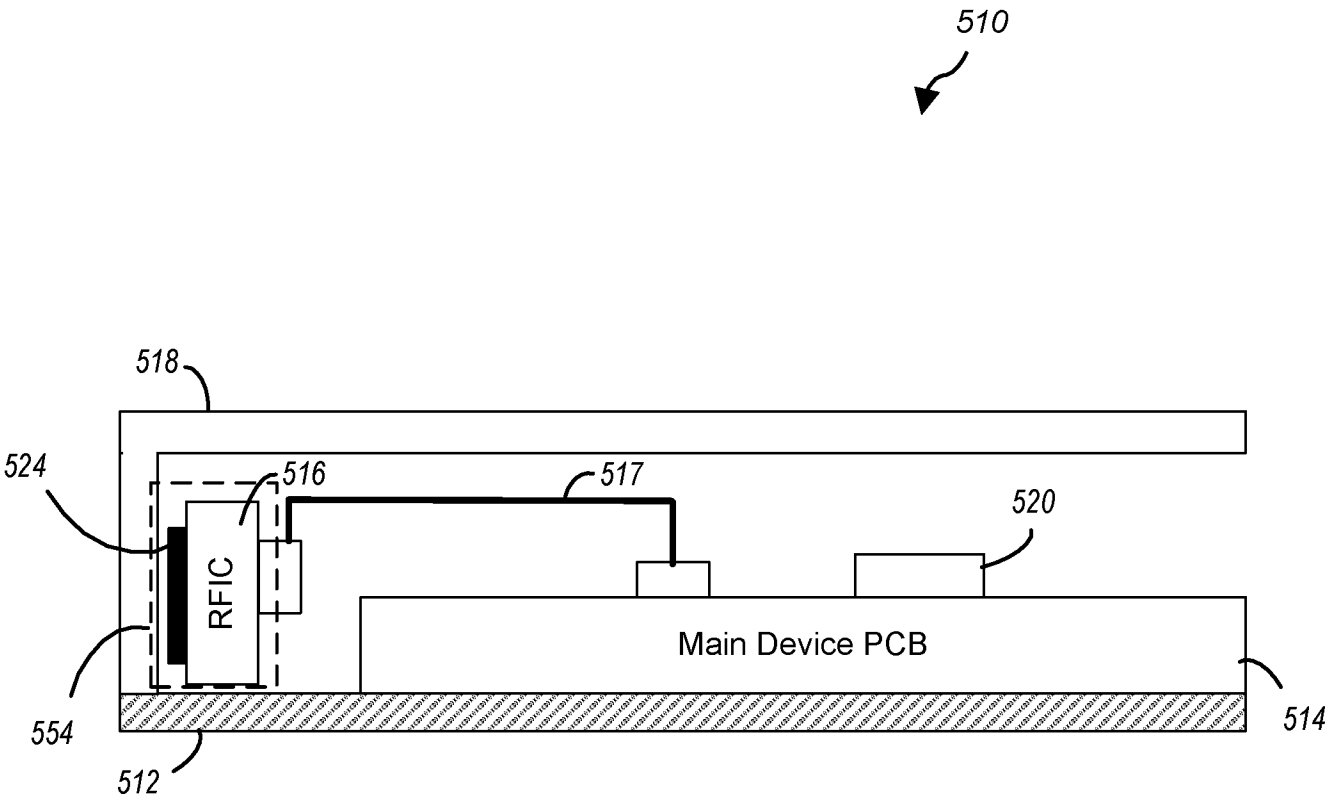
FIG. 5A shows a side view of an example patch antenna array in a wireless device.

Referring to FIG. 5A, a side view of an example patch antenna array in a wireless device 510 is shown. The wireless device 510 includes a display device 512, a device cover 518, and a main device printed circuit board (PCB) 514. The main device PCB 514 may be at least one printed circuit board or a plurality of printed circuit boards. One or more antenna modules 554 may be disposed on the outer edge of the wireless device 510, for example near a top (as illustrated with the array 340 in FIG. 3), bottom, or side of the device 510. Each of the antenna modules 554 may be operably coupled to the main device PCB 514 via one or more cabling assemblies 517. The cabling assemblies may include connectors configured to mate with one or more of the antenna modules 554 and the main device PCB 514. In an embodiment, a MMW module PCB 520 may be operably coupled to the main device PCB 514, and the one or more antenna modules 554 may be coupled to the MMW module PCB 520 via one or more cable assemblies. The antenna module 554 includes an antenna array 524 and may include at least one radio frequency integrated circuit (RFIC) 516. The RFIC 516 may be configured to adjust the power and/or the radiation beam patterns associated with the antenna array 524. The RFIC 516 is an example of an antenna controller and may be configured to utilize phase shifters and/or hybrid antenna couplers to control the power directed to the antenna array and to control the resulting beam pattern. Additional antenna modules 554 may be operably coupled to the main device PCB 514 with one or more cables. While the antenna module 554 is illustrated as being disposed on the outer edge of the device 510 in FIG. 5A, those of skill in the art will appreciate that an antenna module may disposed anywhere in the device. In some implementations of the embodiment illustrated in FIG. 5A, the antenna module is configured to emit and/or receive radiation through an edge of the device, for example in a direction that is roughly perpendicular to the portion of the device cover 518 illustrated on the left side of the figure. In some embodiments, one or more antenna arrays are configured to emit and/or receive radiation through a front or back of the device 510.

Figure 5B:
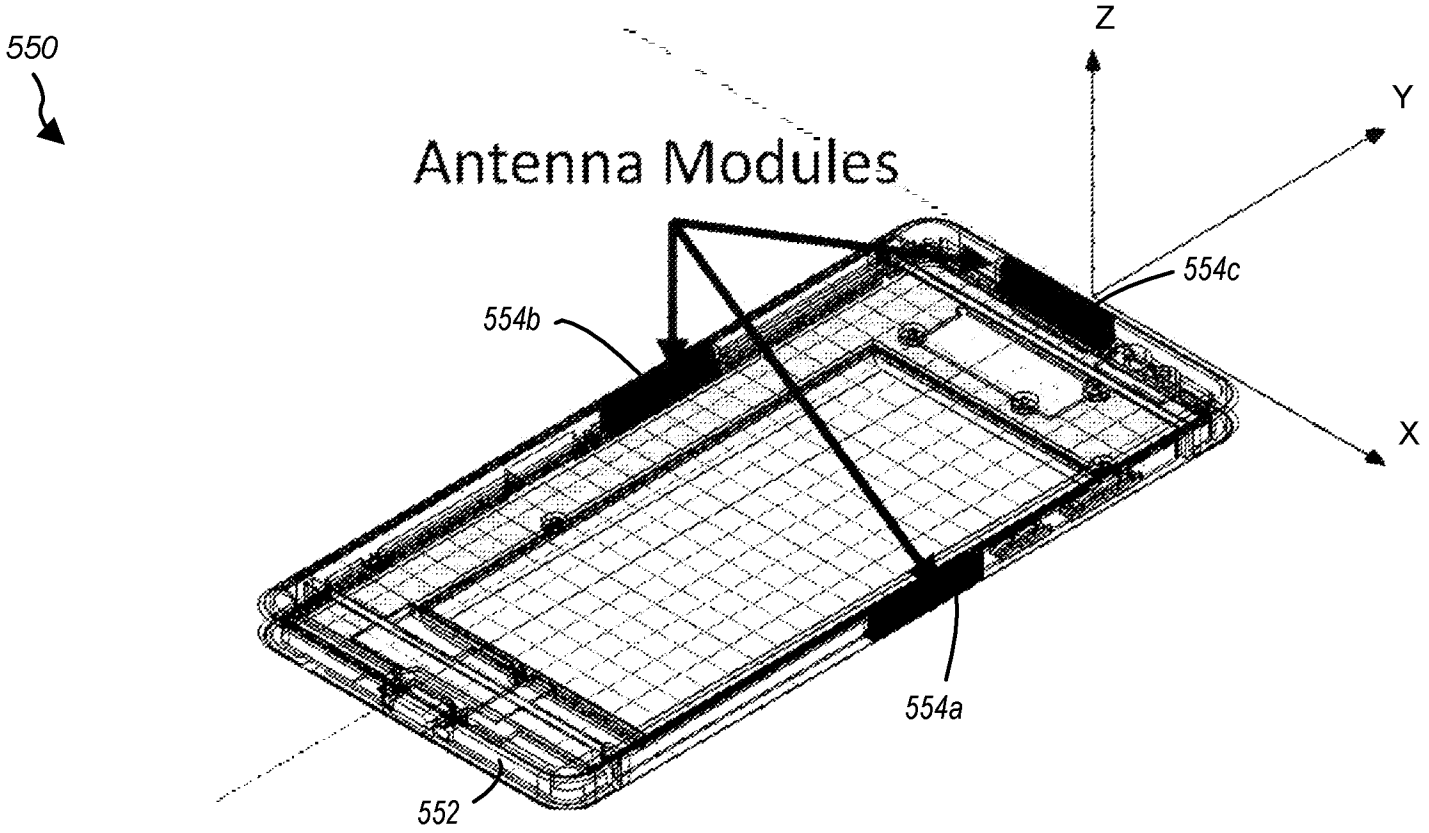
FIG. 5B shows a perspective view of multiple antenna modules in a wireless device.

Referring to FIG. 5B, a perspective view of multiple antenna modules 554*a-c* in a wireless device 550 is shown. The antenna modules 554*a-c* are examples of the antenna modules 554 in FIG. 5A. The wireless device 550 includes a frame 552 configured to receive the antenna modules 554*a-c* along the edges as depicted in FIG. 5B. In general, the thickness of the edges of the wireless device 550 are reducing in size due to market demands. For example, future wireless devices may have edge thicknesses that are less than 4.0 millimeters. The frame 552 may include one or more mounting assemblies configured to secure one or more antenna modules 554*a-c* along the edges to improve the coverage area of the wireless device 550. The multiple antenna modules 554*a-c* enable 3D operation such as depicted in FIG. 3. The locations of the antenna modules 554*a-c* are examples only as different wireless devices may have other edge features/controls such as volume, on/off, scroll wheels, etc. which may impact the antenna configuration.

Figure 6:
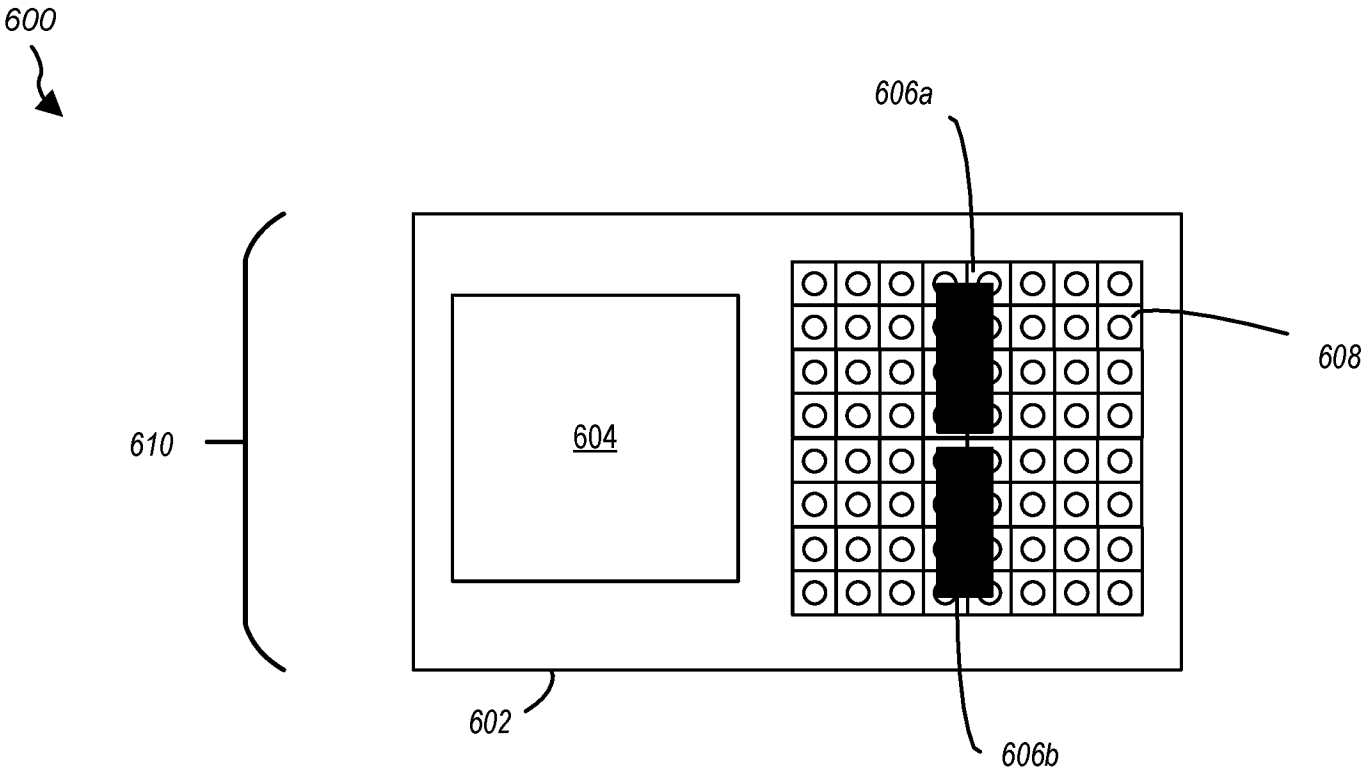
FIG. 6 shows a top view of an example compact patch and dipole array.

Referring to FIG. 6, a top view of an example compact patch dipole array 600 is shown. Certain patch and edge-fed dipole combined antenna modules provide spherical coverage because the patch element and the dipole element radiate in different directions. For example, some such patch and edge-fed dipole combinations include a linear array of patches combined with dipoles that physically project outward in a direction perpendicular to the line along which the patches are disposed. The dipoles in these combinations may communicate with a beam that is orthogonal to the line and generally in a plane in which the patches are disposed. Such configurations, however, may be too large to fit into a low-profile smartphone's form factor (e.g., due to the outwardly projecting dipole elements), such as depicted in FIG. 5B. In the array 600, in contrast, the dipole element is disposed next to the patch element (e.g., along the line of the linear array of antenna elements). For example, the array 600 is disposed on a substrate 602 and includes a patch antenna element 604 and a dipole antenna including a first dipole element 606*a* and a second dipole element 606*b*. The dipole elements 606*a-b* are disposed over a High Impedance Surface (HIS) structure 608. The HIS structure may also be referred to as an Electromagnetic Band Gap (EBG) structure. The inline orientation of the patch antenna element 604 and the dipole antenna elements 606*a-b* enables a narrow edge profile dimension 610. For example, the edge profile dimension 610 for a 5G compact patch dipole array 600 is less than 4 mm in some embodiments, for example approximately 3.5 mm in some such embodiments. The HIS structure 608 is used to mitigate the impact of patch ground on the dipole performance. Specifically, the HIS structure 608 is disposed underneath the dipole elements 606*a-b* to suppress image effects. The HIS structure 608 may also improve the patch-to-patch isolation in a multi-element array due to the high surface impedance of the structure. In general, the larger HIS size provides the better HIS performance (i.e., high impedance properties). The HIS structure typically extends outside patch area to reduce negative impact to the patch antenna operation. In an example, the HIS size is about 2 mm square, which may be in a range from an area of full use of the empty area between patches minus two times the patch edge clearance (e.g., about 2*0.5 mm for mmWave patch antenna). In an example, the patch ground to patch distance is approximately 0.5 mm.

Figure 7C:
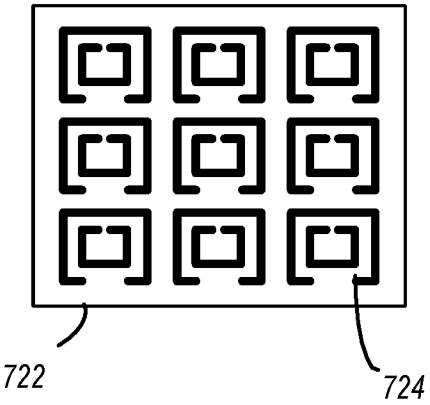
FIGS. 7A-7C show top and side views of example high impedance structures for a millimeter wave dipole antenna.
Figure 7C:
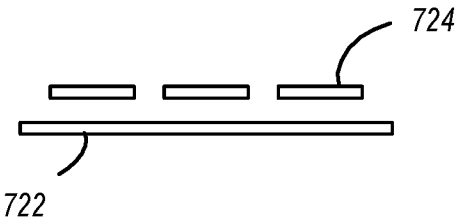
Figure 7B:
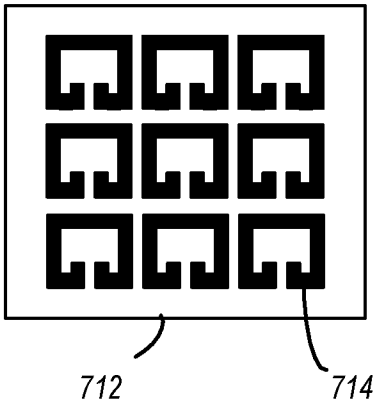
Figure 7B:
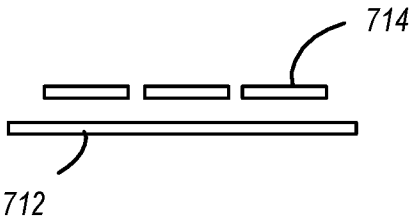
Figure 7A:
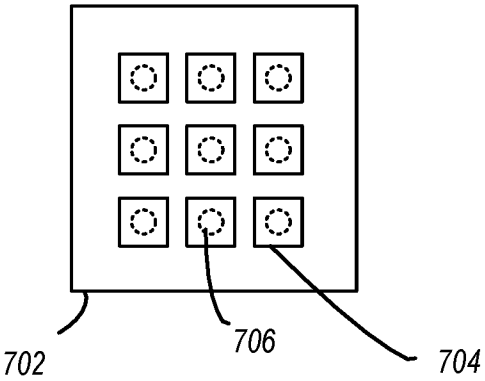
Figure 7A:
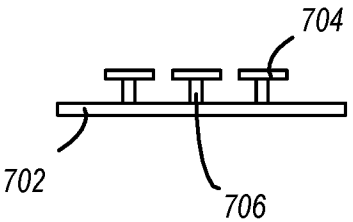

Referring to FIGS. 7A-7C, top and side views of example high impedance structures for a millimeter wave dipole antenna are shown. In general, the high impedance structures are metallic strips or patches installed parallel to an antenna ground plane. The metallic structures may form resonant LC structures and thus increase the impedance of the HIS. FIG. 7A depicts a mushroom-type HIS including a plurality of metallic patches 704, each connected to a ground plane 702 with a metallic via 706. The dimensions of the metallic patches 704 and the size of the gap between each patch may vary based on the operational frequency of the antenna array. In an example, the width of each of the metallic patches 704 is in a range of 0.25 to 1.25 mm, and the gap between the metallic patches 705 may be in a range of 0.01 to 0.15 mm. FIG. 7B depicts a ring-type resonator including a plurality of metallic rings 714 disposed above a ground plane 712. The diameter of each of the metallic rings 714 is approximately in a range of 0.25 to 1.25 mm in some embodiments. FIG. 7C depicts a split-ring resonator (SRR) type, including a plurality of split-rings 724 disposed above a ground plane 722. The outer diameter of each split-ring 724 is approximately in a range of 0.25 to 1.25 mm in some embodiments. The shape and dimensions of the example high impedance structures in FIGS. 7A-7C are examples only, and not a limitation, as other high impedance structures or electromagnetic band gap (EBG) structures may be used in a compact patch and dipole interleaved array antenna. In each of the example high impedance structure depicted in FIGS. 7A-7C, the respective ground planes 702, 712, 722 may be the ground plane for a plurality of elements in an antenna array.

Figure 8:
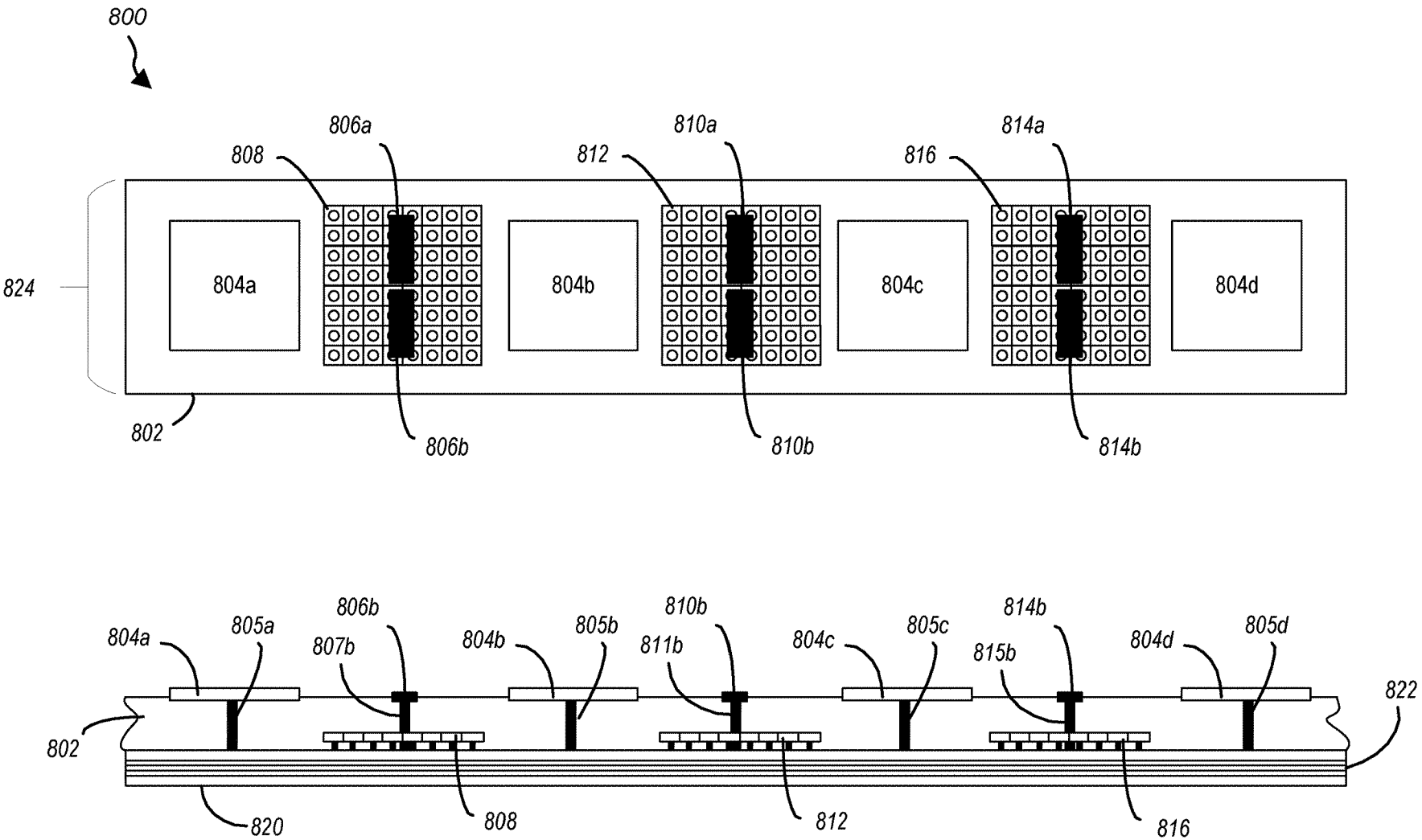
FIG. 8 shows a top view and a side view of an example compact patch and dipole interleaved array antenna.

Referring to FIG. 8, with further reference to FIGS. 5A-7, a top view and a side view of an example compact patch and dipole interleaved array antenna 800 is shown. The array antenna 800 may be operably coupled to, or integrated with, a main device PCB 514. For example, the array antenna 800 may be an antenna array 524 of the antenna module 554 depicted in FIG. 5A, or one of the antenna modules 554*a-c* depicted in FIG. 5B that is operably coupled to the RFIC 516, or other control circuit. The array antenna 800 is manufactured on PC board material 820 including a plurality of metallic strips as feed lines 822. The feed lines 822 may be operably coupled to an RFIC 516 or other transmitting or receiving circuits. The PC board 820 may further include a copper or other conductive cladding at an interface between the PC board material and a dielectric substrate 802, which cladding may provide a ground plane. The antenna may include a first patch antenna 804*a*, a second patch antenna 804*b*, a third patch antenna 804*c*, and a fourth patch antenna 804*d*. Three dipole antennas are interleaved between (or alternate with) the four patch antennas 804*a-d*. A first dipole antenna is disposed between the first patch antenna 804*a* and the second patch antenna 804*b*, and includes a first element

806*a*, a second element 806*b*, and a first HIS 808. A second dipole antenna is disposed between the second patch antenna 804*b* and the third patch antenna 804*c*, and includes a first element 810*a*, a second element 810*b*, and a second HIS 812. A third dipole antenna is disposed between the third patch antenna 804*c* and the fourth patch antenna 804*d* and includes a first element 814*a*, a second element 814*b*, and a third HIS 816. It will be understood that in configurations in which the patch antenna 804*a* and/or 804*d* are omitted the dipole antennas are still considered to be interleaved between the patch antennas. Each of the patch antennas 804*a-d* is operably coupled to one or more feed lines 822 through one or more vias. For example, a first via 805*a* is a feed for the first patch 804*a*, a second via 805*b* is a feed for the second patch 804*b*, a third via 805*c* is a feed for the third patch 804*c*, and a fourth via 805*d* is a feed for the fourth patch 804*d*. Each patch may have additional feed lines for a first polarization and a second polarization, such as a horizontally polarized feed and a vertically polarized feed. Each element in the dipole antennas is also connected to a feed line through a respective via. As depicted in FIG. 8, the second elements of the dipole antennas (i.e., 806*b*, 810*b*, 814*b*) are respectively connected to a first dipole via 807*b*, a second dipole via 811*b*, and a third dipole via 815*b*. The first elements of the dipole antennas (i.e., 806*a*, 810*a*, 814*a*) are also connected to feed lines through respective vias (not shown in FIG. 8). The RFIC 516, or other transmitting and receiving circuits, may utilize a differential feed network for each of the elements in the dipole antennas. The high impedance structures 808, 812, 816 illustrated in FIG. 8 include the mushroom-type HIS depicted FIG. 7A. Other high impedance or electromagnetic band gap structures may be used, for example any of the structures depicted in FIGS. 7B, 7C, or any other high impedance or electromagnetic band gap structures.

In operation, a narrow edge profile dimension 824 of the array antenna 800 enables the installation of multiple antenna modules on a mobile device (e.g., the antenna modules 554*a-c*) to support better air spherical coverage and thus make more reliable wireless communications possible. In an example, the edge profile dimension 824 is less than 4.0 mm, for example 3.5 mm or less. The presence of the high impedance structures 808, 812, 816 improve the performance of the dipole antennas because the high impedance structures 808, 812, 816 reduce the impact of the patch ground on the interleaved dipole antennas. For example, the presence of the high impedance structures 808, 812, 816 may increase the gain and improve the impedance matching, particularly at lower portions of a frequency band. The high impedance structures 808, 812, 816 also improve the patch-to-patch isolation between the patches 804*a-d* due to the high surface impedance. In an example, the dipole antenna elements 806*a-b*, 810*a-b*, 814*a-b* may operate at the same operational frequency as the patches 804*a-d* and provide additional radiation power (as compared to the patches alone) and improved effected isotropic radiated power (EIRP). In some embodiments in which the dipole antenna elements 806*a-b*, 810*a-b*, 814*a-b* operate at the same operational frequency as the patches 804*a-d*, the dipole antenna elements 806*a-b*, 810*a-b*, 814*a-b* are configured to communicate using signals with a first polarization and one or more or of the patches 804*a-d* are configured to communication using signals with a second (different) polarization.

In operation, both the patches 804*a-d*, the dipole antenna elements 806*a-b*, 810*a-b*, 814*a-b* are configured to radiate in substantially the same direction (e.g., referring to FIG. 5B, if the array antenna 800 is used to implement the antenna module 554*a*, the patches 804*a-d* and the dipole antenna elements 806*a-b*, 810*a-b*, 814*a-b* may be configured to radiate out of plane in approximately the +X direction). The design of the compact patch and dipole interleaved array antenna 800 enables both the patch and dipole elements to radiate in the same direction, whereas in other patch and dipole antenna designs the dipole elements may radiate to the sides of the array and the patch elements may radiate perpendicular to the plane of the patch.

In an example, dual band operation may be realized with the array antenna 800 by tuning the patches 804*a-d* to a first operational frequency and the dipole antenna elements 806*a-b*, 810*a-b*, 814*a-b* to a second operational frequency. For a 5G wireless device, the patches 804*a-d* may be configured to operate at 28 GHz and the dipole antenna elements 806*a-b*, 810*a-b*, 814*a-b* may be configured to operate at 39 GHz. In this 5G example, the patches 804*a-d* may be approximately 2×2 mm to 2.5×2.5 mm and the dipole antenna elements 806*a-b*, 810*a-b*, 814*a-b* may each be approximately 1 to 1.5 mm in length. Other dimensions may be used to match the impedance of the array antenna 800 for the desired operational frequencies. In an example, the patches 804*a-d* may include two feed points for a 28 GHz horizontally polarized signal and a 28 GHz vertically polarized signal. While the patch antennas illustrated herein are approximately square in shape, in other embodiments one or more patch antennas (e.g., one or more of the patches 804*a-d*) are a different shape. For example, a patch antenna may be rectangular and may be configured to radiate in two different frequencies (e.g., along a longer edge of the rectangle and along a shorter edge of the rectangle, respectively). In such embodiments one of the two frequencies may be the same as the operational frequency of the dipole antenna elements, or the two frequencies may both differ from the operational frequency of the dipole antenna elements. In other embodiments, a multilayer patch having substantially square elements that are configured to radiate at a plurality of frequencies is implemented. In some embodiments, more than two feeds may be coupled to each patch antenna (for example, to support multiple polarizations at multiple frequencies). While the array antenna 800 includes four patches and three dipole antennas, arrays with fewer or additional patches and/or dipole antennas may be used. Further, while the compact patch and dipole interleaved array antenna 800 may have antenna array element spacing of approximately 0.4 to 0.7 times the free-space wavelength range, other element spacings may be used to modify the beam gain performance and beam shape attributes (e.g., reduce grating lobes). In some examples, the presence of the HIS may enable closer spacing of the patch elements in the array. In one such example, the smaller array length may reduce the antenna gain due to the corresponding antenna aperture reduction.

Figure 9:
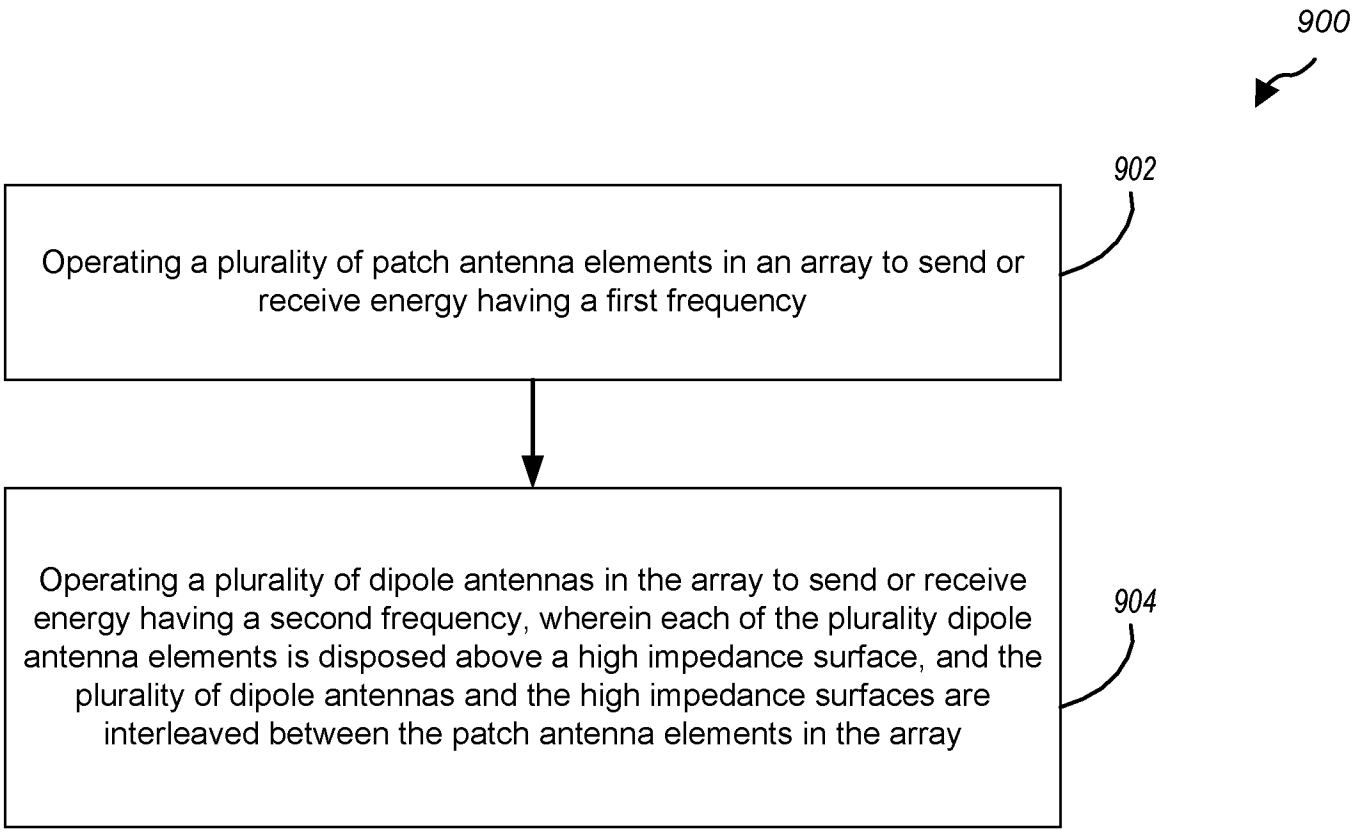
FIG. 9 is an example process flow for sending or receiving a signal with a compact patch and dipole interleaved array antenna.

Referring to FIG. 9, with further reference to FIGS. 1-8, a method 900 for sending or receiving a signal with a compact patch and dipole interleaved array antenna includes the stages shown. The method 900 is, however, an example only and not limiting. The method 900 may be altered, e.g., by having stages added, removed, rearranged, combined, performed concurrently, and/or having single stages split into multiple stages.

At stage 902, the method 900 includes operating a plurality of patch antenna elements to send or receive energy having a first frequency. The radio frequency integrated circuit 516 is a means for operating the plurality of patch elements. Referring to the array antenna 800 in FIG. 8, the plurality of patch elements may be the patches 804*a-d* operably coupled to the RFIC 516 through one or more vias 805*a-d* and the feed lines 822. Additional cabling may be used to couple the array antenna 800 to the RFIC 516, or other transmit and receive circuits. The RFIC 516 may be coupled to the main device PCB 514 or the MMW module PCB 520 via one or more cable assemblies 517. Each of the patches may be configured with a single feed point or dual feed points for dual-polarization operations. In an example, the first frequency may be associated with 5G operations such as 28 GHz or 39 GHz. Other frequencies may be used.

At stage 904, the method 900 includes operating a plurality of dipole antennas to send or receive energy having a second frequency, wherein each of the plurality of dipole antennas is disposed above a high impedance surface, and the plurality of dipole antennas and the high impedance surfaces are interleaved between the patch antenna elements in the plurality of patch antenna elements. The radio frequency integrated circuit 516 is a means for operating the plurality of dipole antennas. Referring to the array antenna 800 in FIG. 8, each dipole antenna includes the dipole elements 806*a-b*, 810*a-b*, 814*a-b* that are operably coupled to the RFIC 516 through respective vias and the feed lines 822. A differential feed network may be used to send or receive energy through the dipole antenna elements 806*a-b*, 810*a-b*, 814*a-b* Additional cabling may be used to couple the array antenna 800 to the RFIC 516, or other transmit and receive circuits. The dipole antenna elements 806*a-b*, 810*a-b*, 814*a-b* are disposed above respective high impedance surfaces 808, 812, 816 which are configured to increase the impedance of the ground plane based on the second frequency. As depicted in FIG. 8, the dipole antenna elements and the high impedance surface are interleaved between the patch antenna elements in the plurality of patch antenna elements. In an example, the second frequency may be the same as the first frequency in stage 902, such as 28 GHz or 39 GHz used in 5G wireless systems. In another example, the second frequency may be different than the first frequency such that the patches 804*a-d* are configured to operate at 28 GHz (e.g., single or dual polarization) and the dipole antenna elements 806*a-b*, 810*a-b*, 814*a-b* are configured to operate at 39 GHz. Other frequencies may also be used, and the patch and dipole dimensions may be varied to reduce the impedance of the RF signal.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

Also, as used herein, "or" as used in a list of items prefaced by "at least one of" or prefaced by "one or more of" indicates a disjunctive list such that, for example, a list of "at least one of A, B, or C," or a list of "one or more of A, B, or C," or "A, B, or C, or a combination thereof" means A or B or C or AB or AC or BC or ABC (i.e., A and B and C), or combinations with more than one feature (e.g., AA, AAB, ABBC, etc.).

As used herein, unless otherwise stated, a statement that a function or operation is "based on" an item or condition means that the function or operation is based on the stated item or condition and may be based on one or more items and/or conditions in addition to the stated item or condition.

Components, functional or otherwise, shown in the figures and/or discussed herein as being connected, coupled (e.g., communicatively coupled), or communicating with each other are operably coupled. That is, they may be directly or indirectly, wired and/or wirelessly, connected to enable signal transmission between them.

"About" and/or "approximately" as used herein when referring to a measurable value such as an amount, a temporal duration, and the like, encompasses variations of ±20% or ±10%, ±5%, or +0.1% from the specified value, as appropriate in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as appropriate in the context of the systems, devices, circuits, methods, and other implementations described herein.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of operations may be undertaken before, during, or after the above elements are considered. Accordingly, the above description does not bound the scope of the claims.

Further, more than one invention may be disclosed.

What is claimed is:

1. A wireless device, comprising:

at least one radio frequency integrated circuit;

at least one patch antenna element operably coupled to the at least one radio frequency integrated circuit;

at least one dipole antenna comprising two dipole antenna elements disposed adjacent to the at least one patch antenna element and operably coupled to the at least one radio frequency integrated circuit; and at least one high impedance surface disposed below the at least one dipole antenna and adjacent to the at least one patch antenna element, wherein the at least one patch antenna element comprises a plurality of patch antenna elements operably coupled to the at least one radio frequency integrated circuit, wherein the at least one dipole antenna and the at least one high impedance surface are interleaved between the plurality of patch antenna elements.

2. The wireless device of claim 1 wherein the at least one patch antenna element and the at least one dipole antenna are configured to send or receive energy having a same frequency.

3. The wireless device of claim 1 wherein the at least one patch antenna element is configured to send or receive energy having a first frequency and the at least one dipole antenna is configured to send or receive energy having a second frequency different from the first frequency.

4. The wireless device of claim 3 wherein the first frequency is approximately 28 GHz and the second frequency is approximately 39 GHz.

5. The wireless device of claim 1 wherein the at least one patch antenna element is configured to send or receive energy having a first polarization and a second polarization.

6. The wireless device of claim 1 wherein the at least one high impedance surface is a mushroom-type high impedance surface.

7. The wireless device of claim 1 wherein the at least one high impedance surface is a ring-type high impedance surface.

8. The wireless device of claim 1 wherein the at least one patch antenna element, the at least one dipole antenna, and the at least one high impedance surface comprise an antenna module disposed along an edge of the wireless device.

9. A wireless device, comprising:

at least one radio frequency integrated circuit;

at least one patch antenna element operably coupled to the at least one radio frequency integrated circuit;

at least one dipole antenna comprising two dipole antenna elements disposed adjacent to the at least one patch antenna element and operably coupled to the at least one radio frequency integrated circuit; and at least one high impedance surface disposed below the at least one dipole antenna and adjacent to the at least one patch antenna element, wherein the at least one patch antenna element is configured to send or receive energy having a first polarization and a second polarization.

10. The wireless device of claim 9 wherein the at least one patch antenna element and the at least one dipole antenna are configured to send or receive energy having a same frequency.

11. The wireless device of claim 9 wherein the at least one patch antenna element is configured to send or receive energy having a first frequency and the at least one dipole antenna is configured to send or receive energy having a second frequency different from the first frequency.

12. The wireless device of claim 11 wherein the first frequency is approximately 28 GHz and the second frequency is approximately 39 GHz.

13. The wireless device of claim 9 wherein the at least one high impedance surface is a mushroom-type high impedance surface.

14. The wireless device of claim 9 wherein the at least one high impedance surface is a ring-type high impedance surface.

15. The wireless device of claim 9 wherein the at least one patch antenna element, the at least one dipole antenna, and the at least one high impedance surface comprise an antenna module disposed along an edge of the wireless device.

16. A wireless device, comprising:

at least one radio frequency integrated circuit;

at least one patch antenna element operably coupled to the at least one radio frequency integrated circuit;

at least one dipole antenna comprising two dipole antenna elements disposed adjacent to the at least one patch antenna element and operably coupled to the at least one radio frequency integrated circuit; and at least one high impedance surface disposed below the at least one dipole antenna and adjacent to the at least one patch antenna element, wherein the at least one patch antenna element, the at least one dipole antenna, and the at least one high impedance surface are included in an antenna module disposed along an edge of the wireless device.

17. The wireless device of claim 16 wherein the at least one patch antenna element and the at least one dipole antenna are configured to send or receive energy having a same frequency.

18. The wireless device of claim 16 wherein the at least one patch antenna element is configured to send or receive energy having a first frequency and the at least one dipole antenna is configured to send or receive energy having a second frequency different from the first frequency.

19. The wireless device of claim 18 wherein the first frequency is approximately 28 GHz and the second frequency is approximately 39 GHz.

20. The wireless device of claim 16 wherein the at least one high impedance surface is a mushroom-type high impedance surface or a ring-type high impedance surface.

* * * * *